United States Patent [19]

Everhart et al.

[11] Patent Number: 4,735,293

[45] Date of Patent: Apr. 5, 1988

[54] HATCHWAY DOOR FOR ELEVATOR SYSTEM

[75] Inventors: Lynn R. Everhart, Gettysburg; Charles E. Randall, Monroe Township, Cumberland County, both of Pa.

[73] Assignee: Westinghouse Electric Corp., Pittsburgh, Pa.

[21] Appl. No.: 936,562

[22] Filed: Dec. 1, 1986

[51] Int. Cl.[4] ..... B66B 13/30; E06B 7/21; E06B 7/215

[52] U.S. Cl. ..... 187/56; 187/52 R; 187/1 R; 49/120; 49/309; 49/310

[58] Field of Search ..... 187/56, 52 LC, 52 R, 187/51, 1 R; 49/313, 314, 310, 309, 306, 120, 483

[56] References Cited

U.S. PATENT DOCUMENTS

| | | | |
|---|---|---|---|
| 1,021,172 | 3/1912 | Widmann et al. . | |
| 1,406,951 | 2/1922 | Fehr . | |
| 1,709,595 | 4/1929 | Schweig | 49/95 |
| 2,987,784 | 6/1961 | Querio | 49/306 |
| 3,027,937 | 4/1962 | Wilson | 49/309 X |
| 3,068,936 | 12/1962 | Haws | 49/309 X |
| 3,337,995 | 8/1967 | Taylor | 49/483 X |
| 3,523,390 | 8/1970 | McAulay, Jr. | 187/56 X |
| 3,734,238 | 5/1973 | Secresty et al. | 187/1 R |
| 4,045,913 | 9/1977 | Wright | 49/309 X |
| 4,058,191 | 11/1977 | Balbo | 187/1 R |
| 4,320,793 | 3/1982 | Lindbergh | 49/310 X |

*Primary Examiner*—Joseph J. Rolla
*Assistant Examiner*—Nils E. Pedersen
*Attorney, Agent, or Firm*—D. R. Lackey

[57] ABSTRACT

A hatchway door for an elevator system which includes a smoke seal. The smoke seal includes a compression seal along the trailing edge of each door panel which engages as the panel reaches the fully closed position, an astragal seal along the leading edge which engages another panel or a return, and sealing arrangements associated with the top and bottom portions of each door panel which seal the associated gaps with a spring loaded cam action which translates horizontal movement of the door panel to vertical movement of each sealing arrangement.

6 Claims, 3 Drawing Sheets

HATCHWAY DOOR FOR ELEVATOR SYSTEM

BACKGROUND OF THE INVENTION

1. Field of the Invention

The invention relates in general to elevator systems, and more specifically to the construction of the hatch door associated with the entranceway from the hallway of a building to the hatchway in which an elevator car is operated.

2. Description of the Prior Art

When a smoke seal is required on elevator hatchway doors, it is conventional to provide a brush type seal. The brush type seal is subject to constant wear, and must be periodically inspected and replaced. Also, since the brush type seal involves relative motion between the sealing parts throughout the entire movement of each door panel, the sealing effectiveness is compromised to enable door movement to be accomplished with a reasonably sized door operator engine on the associated elevator car.

It would be desirable to provide a new and improved smoke seal for elevator hatchway doors which does not require constant maintenance, and which is more effective than a brush type seal.

SUMMARY OF THE INVENTION

Briefly, the present invention is a new and improved hatchway door for an elevator system which includes a smoke seal which is highly effective in terms of sealing the gap between the hatchway door and the surrounding entranceway, and which requires little maintenance. A compression seal is provided along the trailing edge of each door panel which engages as the door panel reaches its fully closed position. The top and bottom edges of each door panel are each sealed by a similar arrangement which is actuated by movement of the associated door panel as it reaches its fully closed position. This arrangement includes a vertically oriented plate member which has a resilient seal along its horizontaly oriented lower edge. The plate member is actuated by movement of the associated door panel as the door panel reaches its fully closed position, translating horizontal movement of the door panel into vertical movement of the plate member along an oblique path, such that the resilient seal just engages an opposing surface which completes the seal as the door panel stops at the fully closed position. The seal is broken as soon as the door panel initiates an opening movement. Thus, there is very little relative motion between the sealing elements, and substantially no wear. The resulting compression seal is highly effective in terms of sealing the associated gap against smoke. The leading edge of each door panel utilizes the conventional astragal to complete the smoke seal for the associated door panel.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

Figure 1:
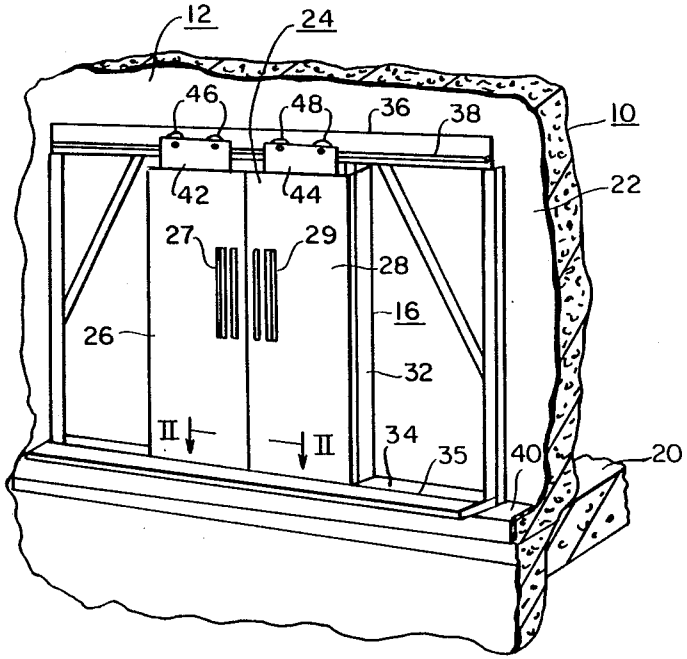
FIG. 1 is a perspective view of an elevator hatchway door, viewed from the hatchway side, which may utilize the teachings of the invention.

Referring now to the drawings, FIG. 1 is a fragmentary perspective view of a building 10 which includes a hatchway 12 of an elevator car 14 (shown in FIG. 5), an entranceway 16 defining an opening 18 (shown in FIG. 3) from a hallway 20 to the hatchway 12, a hatchway wall 22 surrounding the opening 18, and a hatchway door 24. The hatchway door 24 includes one or more door panels, depending upon whether it is side or center opening, and whether or not it is a single or a two speed door arrangement. The arrangement illustrated for purposes of example is a center opening, single speed arrangement having first and second door panels 26 and 28, respectively. The door panels 26 and 28 include drive block assemblies 27 and 29, respectively, which are engaged by a clutch and vane assembly, identified generally with reference 31 in FIG. 5, which is part of the door assembly of the elevator car 14. The door operator (not shown) on the elevator car 14 provides the motive force for opening and closing the hatchway door assembly 24.

The entranceway 16 includes a side jamb 30 (shown in FIG. 3), a side jamb 32, a hatchway door sill 34, a head jamb 36, and a door hanger track 38. The door sill 34, which includes a gib slot 35 is disposed on a cross beam 40 which is part of the building 10. The door panels 26 and 28 include hangers 42 and 44, respectively, which have hanger rollers 46 and 48, respectively, which ride on the hanger track 38, and each door panel includes a gib which rides in a gib slot of the door sill, such as the gib 49 shown in FIG. 3 on the bottom of door panel 26.

Figure 2:
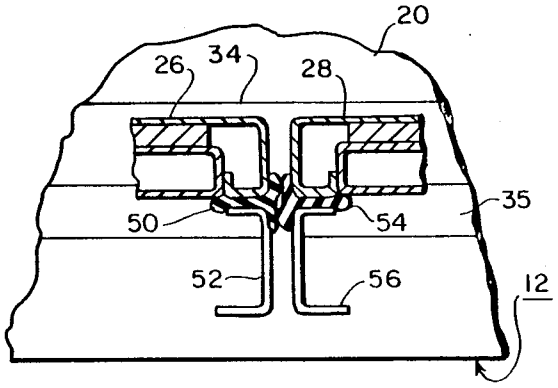
FIG. 2 is a cross sectional view of the hatchway door shown in FIG. 1, taken between and in the direction of arrows II—II in FIG. 1, illustrating a smoke seal formed by the astragals on the leading edges of the door panels.

FIG. 2 is a cross sectional view of the mating edges of the door panels 26 and 28 illustrating an astragal 50 and sight guard 52 on door panel 26 and an astragal 54 and sight guard 56 on door panel 28. The astragals 50 and 54 cooperate as illustrated, when their associated door panels 26 and 28 are in the fully closed position, to provide a smoke seal. This is conventional and is not part of the present invention. The astragal sealing arrangement is utilized to complement the sealing arrangements constructed according to the teachings of the invention, which arrangements are associated with the remaining edges of the door panels. On a side opening hatchway door construction, the astragal would be on the leading edge of the door panel which contacts the return post.

Figure 3:
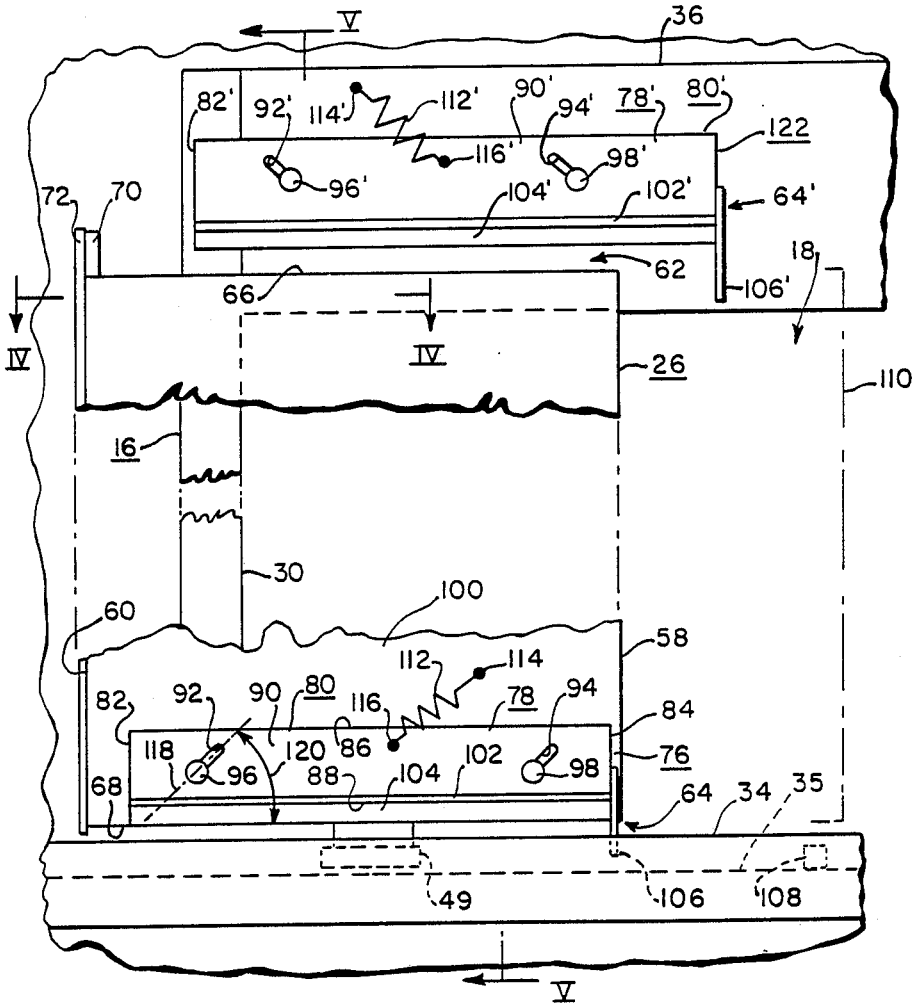
FIG. 3 is an elevational view of a door panel constructed according to the teachings of the invention, which construction may be applied to the door panels of the elevator hatchway door shown in FIG. 1.

FIG. 3 is an elevational view of door panel 26 shown from the hatchway side, fitted with sealing arrangements constructed according to the teachings of the invention. In order to better illustrate the locations of the various elements of the sealing arrangements, the door hanger track 38 and the door hanger 42 are not shown in FIG. 3. Door panel 26 has leading and trailing edges 58 and 60, respectively, and upper and lower portions 62 and 64, respectively, with the upper and lower portions 62 and 64 including edges or surfaces 66 and 68, respectively, the planes of which are horizontally oriented. As hereinbefore described relative to FIG. 2, the leading edge 58 is provided with an astragal 50 (not shown in FIG. 3), which is part of a smoke seal for this edge of the associated door panel.

Figure 4:
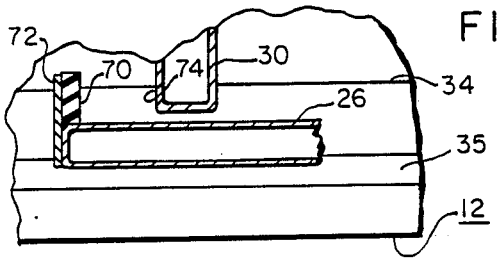
FIG. 4 is a cross sectional view of the door panel shown in FIG. 3, taken between and in the direction of arrows IV—IV in FIG. 3, illustrating how a compression smoke seal is formed along the trailing edge of each door panel, as the door panel reaches a fully closed position.

The trailing edge 60 of door panel 26 cooperates with a selected portion of the entranceway 16, such as the side jamb 30, via a resilient member 70, to provide a smoke seal for this edge of the door panel. The resilient means is attached to either the trailing edge 60 of the door panel 26, or to the entranceway 16, such that the resilient means is compressed to create a smoke seal as the door panel 26 reaches its fully closed position. As illustrated in FIG. 3 for purposes of example, and also in FIG. 4, which is a cross sectional view taken between and in the direction of arrows IV—IV in FIG. 3, the resilient means 70 may be mounted to the trailing edge 60 of door panel 26 by a mounting bracket 72, with resilient means being compressed against surface 74 of side jamb 30 during the last fraction of an inch of travel of door panel 26 as it arrives at the fully closed position.

The clearance gap between the bottom portion 64 of door panel 26 and the entranceway 16, necessary for relative movement when the door panel 26 is actuated between its fully closed and fully open positions, is sealed by a smoke seal arrangement 76. Smoke seal arrangement 76 includes movable means 78 mounted on door panel 26 for guided rectilinear motion such that horizontal movement of the movable means 78 translates to vertical movement along an oblique angle relative to a horizontal plane. More specifically, movable means 78 includes an elongated metallic plate member 80 which may be rectangular in configuration. Plate member 80 has first and second ends 82 and 84, respectively, upper and lower edges 86 and 88, respectively, and first and second major opposed surfaces, such as surface 90. Spaced elongated openings 92 and 94 are disposed between the major opposed surfaces.

Plate member 80 is disposed adjacent to the lower portion 64 of door panel 26, oriented with its major flat surfaces in vertical planes and with its upper and lower edges horizontal, and it is mounted for slidable rectilinear motion via pins 96 and 98 which are fixed to surface 100 of door panel 26. Pins 96 and 98 have shank portions sized to snugly but slidably extend through openings 92 and 94, respectively, and head portions which hold plate 80 captive to the door panel 26.

Plate member 80 has a flange 102 attached to its lower edge 88, or, alternatively, flange 102 may be integral with plate member 80, as desired. A resilient member 104 is fixed to the bottom surface of flange 102. An actuating arm 106 is fixed to the second end 84 of plate member 80, with the actuating arm extending downwardly into the gib slot 35. An actuator 108 is fixed in the gib slot 35 at a location which will cause it to contact the actuator arm 106 as the door panel 26 approaches its fully closed position, shown with broken line 110. The dimension between the location of actuator 108 and the fully closed position indicated by broken line 110 is about 0.5 inch, for example. Bias means, such as a tension spring 112 has one end fixed to surface 100 of door panel 26 via a pin 114, and the other end fixed to surface 90 of plate member 80 via a pin 116. An imaginary line through pins 114 and 116 is parallel with the direction of elongation of the elongated openings 92 and 94.

Figure 6:
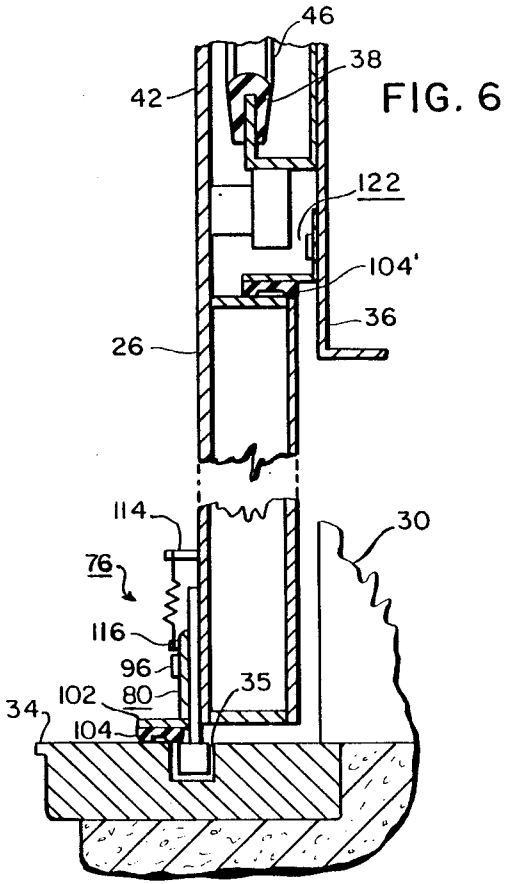
FIG. 6 is a cross sectional view of a hatchway door panel which is similar to that of FIG. 5, except illustrating the smoke sealing arrangements for the upper and lower portions of a door panel in their actuated positions.
Figure 5:
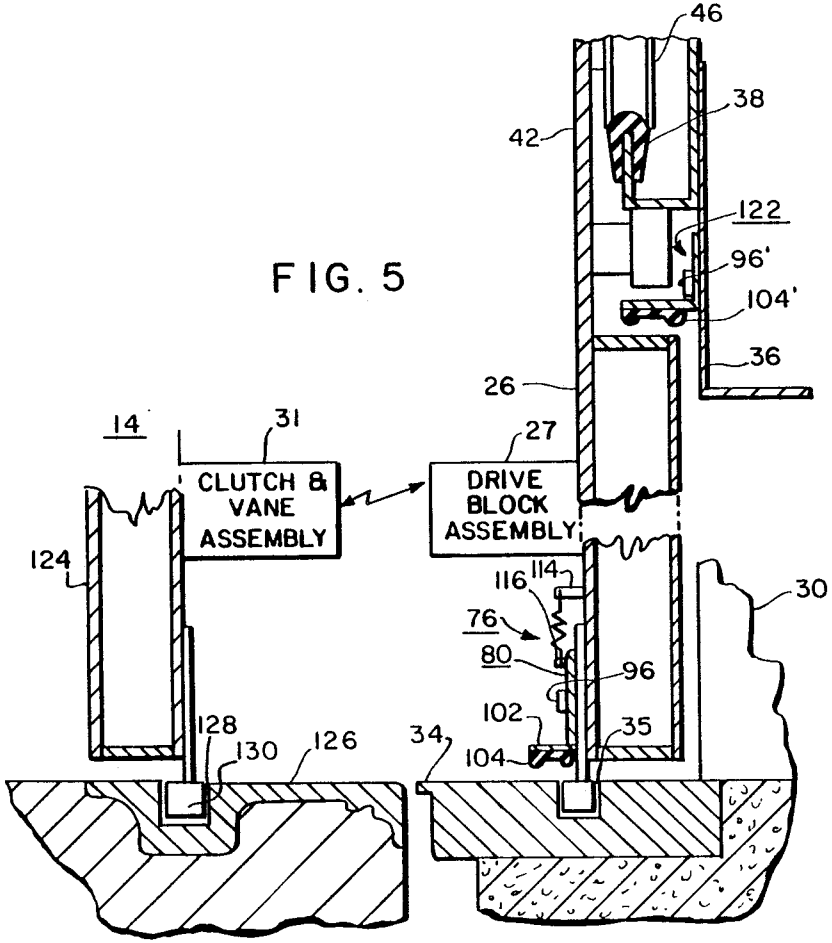
FIG. 5 is a cross sectional view of the door panel shown in FIG. 3, taken between and in the direction of arrows V—V in FIG. 3, as well as a portion of an elevator car, illustrating smoke sealing arrangements for the upper and lower portions of each hatchway door panel in their unactuated positions.

In the operation of the the smoke seal arrangement 76, it will first be assumed that the door panel 26 is not in its fully closed position, such as in the partially open position illustrated in FIG. 3, and the cross sectional view of FIG. 5. FIG. 5 is a cross sectional view of door panel 26 taken between and in the direction of arrows V—V in FIG. 3. FIG. 5 also illustrates elevator car 14 immediately adjacent to hatch door 24, with elevator car 1 including a door 124, and a car door sill 126 having a gib slot 128 which guides door 124 via a gib 130 fixed to door 124. The clutch and vane assembly 31 of elevator car door 124 has engaged the drive block assembly 27 of the hatch door panel 26, enabling the car door 124 to drive the hatch door panel 26. When door panel 26 is not fully closed, the bias means or spring 112 biases the plate 80, causing it to be lifted until pins 96 and 98 stop any further movement by contacting the lower ends of the elongated openings or slots 92 and 94. Openings 92 and 94 are each oriented such that a longitudinal centerline through the opening, such as longitudinal centerline 118 through opening 92, intersects the horizontally oriented plane of the lower surface 88 of plate 80 with a predetermined angle 120, which is about 45 degrees in a preferred embodiment of the invention. When door panel 26 is driven by the clutch and vane assembly 31 of elevator car 14 towards the fully closed position, actuator arm 106 contacts actuator 108 to stop plate 80 while the door panel continues to move. This translates the horizontal movement of the door panel 26 to vertical movement of the resilient member 104, as plate 80 is cammed down the inclined openings 92 and 94 against the bias of the bias means 112. The bias means 112 is overcome about 0.5 inch from the fully closed position, and the resilient member 104 contacts the hatch sill 34 about 0.25 inch from the fully closed position of the door panel 26, with the last 0.25 inch of door movement compressing the resilient member by about the same 0.25 inch dimension to assure a tight smoke seal between the resilient member 104 and the hatch sill 34. FIG. 6 is a view of door panel 26 which is similar to FIG. 5, except illustrating the door panel 26 in the fully closed position with the smoke seal arrangement 76 actuated to its sealing configuration.

As soon as the door panel 26 starts to move away from the fully closed position, the resilient means 104 is immediately decompressed and lifted from the hatch sill 34, within the first 0.5 inch of movement, thus substantially eliminating relative sliding movement of the type which would cause wear and maintenance problems. It will be noted that the disclosed smoke seal arrangement 76 is fail safe. If the spring 112 should break, the door panel 26 would still be operable, as the resilient member 104 would not be forced down tightly against the sill 34, once the door panel has been moved about 0.25 inch from its fully closed position.

The upper portion 62 of the door panel 26 is provided with a smoke sealing arrangement 122 which is similar in operation to the smoke sealing arrangement 76 just described, with components in arrangement 122 which are the same as those in arrangement 76 being given the same reference numerals with the addition of a prime mark. A major difference is in the orientation of openings 92' and 94', with openings 92' and 94' being oriented perpendicular to the orientation of openings 92 and 94. Also, instead of the movable means 78' being mounted on the movable door panel 26 it is mounted on stationary head jamb 36. The spring 112' also has one end fixed to the head jamb, i.e., pin 114' is fixed to the head jamb. Finally instead of a stationary actuator 108, the actuator for smoke sealing arrangement 122 is the door panel itself, such as the leading edge 58.

In the operation of the smoke sealing arrangement 122, the leading edge 58 of door panel 26 contacts actuator 106' just before the door panel reaches its fully closed position. This translates the horizontal motion of the door panel to vertical motion of the movable means 78', forcing the resilient member 104' downwardly against the upper edge or surface 66 of door panel 26 substantially with the door panel reaching its fully closed position, to effect the smoke seal with very little relative movement between the sealing elements, i.e., the resilient means 104' and the upper edge 66 of the door panel 26. The upper edge smoke sealing arrangement 122 releases when the door panel 26 starts to open, to prevent wear between the resilient member 104' and the upper edge 66 of the door panel 26. FIGS. 5 and 6 illustrate the smoke sealing arrangement 122 in the retracted and applied positions, respectively.

In summary, there has been disclosed a new and improved arrangement for providing a smoke seal for the hatchway doors of an elevator system. The new and improved smoke seal includes arrangements which seal the clearance gaps at the upper and lower edges of a door panel by a camming action which becomes effective during the last fraction of an inch of car travel, to provide a highly effective smoke seal with little relative motion between the elements of the seal. A compression seal is effected along the trailing edge of the door panel as the door reaches its fully closed position, and the seal along the leading edge of a door panel is also established at this point in time via the conventional astragal on the leading edge of the hatchway door panel.

We claim as our invention:

1. An elevator system, comprising:

a building having an elevator hatchway, and an entranceway defining an opening to said hatchway, including a hatchway wall surrounding said opening, said entranceway having a hatch sill and a gib slot, a hatchway door having at least one door panel, said at least one door panel having vertically oriented leading and trailing edges, upper and lower portions, and a gib disposed in said gib slot for guiding the lower portion of said at least one door panel, means mounting said at least one door panel in said entranceway for horizontal, slidable movement between fully open and fully closed positions, to selectively open and close the opening to said hatchway while maintaining first and second clearance gaps between the lower and upper portions, respectively, of said at least one door panel and the entranceway, and first smoke sealing means for automatically sealing and unsealing said first clearance gap in response to closing and opening movements, respectively, of said at least one door panel, said first smoke sealing means including movable means mounted on said at least one door panel for guided rectilinear movement between sealed and unsealed positions, bias means carried by the at least one door for biasing said movable means towards said unsealed position, and bias opposing means disposed in said gib slot for opposing the bias of said bias means in response to said at least one door panel being within a predetermined dimension from said fully closed position, said movable means physically contacting said hatch sill when in said sealed position, with said physical contact occurring substantially simultaneously with the stopping of said at least one door panel at said fully closed position, said physical contact being broken substantially simultaneously with initial opening movement of said at least one door panel, whereby sliding contact between said movable means and said predetermined object is substantially eliminated.

2. The elevator system of claim 1 wherein the rectilinear movement of the movable means of the first smoke sealing means is oriented at an angle of about 45 degrees to a horizontal plane.

3. The elevator system of claim 1 including resilient means disposed to be compressed between the at least one door panel and the entranceway when the at least one door panel reaches the fully closed position, to provide a smoke seal between the trailing edge of the at least one door panel and the entranceway.

4. The elevator system of claim 1 wherein the movable means of the first smoke sealing means includes a vertically oriented plate member having a lower surface, resilient means fixed to said lower surface, and means mounting said plate member such that horizontal movement of said plate member translates to vertical movement of said resilient means.

5. The elevator system of claim 4 wherein the means for mounting the plate member includes elongated openings oriented at a predetermined angle relative to the lower surface of the plate member, and means in said openings which enable the plate member to slide in the direction of orientation of said elongated openings.

6. The elevator system of claim 1 including second smoke sealing means for automatically sealing and unsealing the second clearance gap in response to closing and opening movements, respectively, of the at least one door panel, said second smoke sealing means including second movable means and second bias means, both mounted on the hatchway wall above the opening to the hatchway, with the second movable means being mounted for guided rectilinear movement between sealed and unsealed positions, and with the second bias means biasing said second movable means towards said unsealed position, and wherein the at least one door panel contacts said second movable means when the at least one door panel is within a predetermined dimension from the fully closed position, to oppose the bias of said second bias means and move said second movable means towards said sealed position, said second movable means physically contacting the upper portion of the at least one door panel when in said sealed position, with said physical contact occurring substantially simultaneously with the stopping of the at least one door panel at the fully closed position, said physical contact being broken substantially simultaneously with initial opening movement of the at least one door panel, whereby sliding contact between said second movable means and the at least one door panel is substantially eliminated.

* * * * *